US006536149B1

(12) United States Patent
Phillips

(10) Patent No.: US 6,536,149 B1
(45) Date of Patent: Mar. 25, 2003

(54) STRUCTURED TRADING CARD DISPLAY KITS

(76) Inventor: David Phillips, 7736 Phlox St., Downey, CA (US) 90241

( * ) Notice: Subject to any disclaimer, the term of this patent is extended or adjusted under 35 U.S.C. 154(b) by 0 days.

(21) Appl. No.: 09/499,528

(22) Filed: Feb. 10, 2000

(51) Int. Cl.[7] ..... G09F 11/00; G09F 11/18; G09F 11/12

(52) U.S. Cl. ..... 40/768; D6/301; 40/777

(58) Field of Search ..... 40/768, 733, 776, 40/777, FOR 156, FOR 158; D6/301, 302

(56) References Cited

U.S. PATENT DOCUMENTS

| | | | | | |
|---|---|---|---|---|---|
| 2,879,774 | A | * | 3/1959 | Siegel | |
| 3,371,439 | A | * | 3/1968 | Smith et al. | |
| 4,794,714 | A | * | 1/1989 | Weisgerber | |
| 4,860,468 | A | * | 8/1989 | Cliborn | 40/124.2 |
| 4,944,968 | A | * | 7/1990 | Wagner | |
| 5,046,616 | A | * | 9/1991 | Makowski et al. | |
| 5,077,921 | A | * | 1/1992 | Mooney | |
| 5,096,752 | A | * | 3/1992 | Wagner | |
| 5,105,567 | A | * | 4/1992 | Real | |
| D331,677 | S | * | 12/1992 | Bates | |
| D333,846 | S | * | 3/1993 | Graham | D20/40 |
| D339,237 | S | * | 9/1993 | Korte | |
| 5,349,770 | A | * | 9/1994 | Bursey et al. | 40/124.2 |
| 5,375,352 | A | * | 12/1994 | Morris | |
| 5,419,062 | A | * | 5/1995 | Polinski et al. | |
| 5,462,167 | A | * | 10/1995 | Polinski et al. | |
| 5,477,631 | A | * | 12/1995 | Hewitt | |
| D366,798 | S | * | 2/1996 | Messersmith | D6/571 |
| 5,546,685 | A | * | 8/1996 | Gallagher | |
| 6,295,750 | B1 | * | 10/2001 | Harwell et al. | 40/661 |

FOREIGN PATENT DOCUMENTS

| | | | |
|---|---|---|---|
| DE | 25 10 650 A1 | * | 9/1976 |
| FR | 2165026 | * | 12/1971 |
| GB | 2245208 A | * | 1/1992 |

OTHER PUBLICATIONS

All Star Framing Co., dated Oct. 22, 2002 (Assembly Instructions and Frame Kit).*

* cited by examiner

*Primary Examiner*—Anthony Knight
*Assistant Examiner*—Vishal Patel
(74) *Attorney, Agent, or Firm*—Kajane McManus

(57) ABSTRACT

The structured trading card display kit provides a way of displaying trading cards in an organized manner, based on a particular index assigned to the kit. The index can be selected from a large possible group and the kit includes structure identifying the index as well as a display assembly.

15 Claims, 2 Drawing Sheets

STRUCTURED TRADING CARD DISPLAY KITS

BACKGROUND OF THE INVENTION

1. Field of the Invention

The present invention relates to structured trading card display kits. More particularly, the kits are provided for creating an organized showing of trading cards, with the cards being structured around specific indicia for each kit. The kits may or may not include the required trading cards therein.

2. Prior Art

Heretofore, various means for storing and/or displaying trading cards have been proposed. However, such means have proffered no structuring or organization in how the cards are displayed. Typically, the cards are merely merged haphazardly into a framed collage with no rhyme or reason thereto.

SUMMARY OF THE INVENTION

Accordingly, there is a need for a structured, organizational kit by means of which trading cards relating to particular indicia can be collected and displayed together, with or without informational data presented therewith.

These as well as other objects are met by the organizational structured trading card display kit comprising a frame, glass surrounded by and seated within the frame, a mat, a backing, and a second piece of glass, the mat being sandwiched between the pieces of glass, and the mat having a predefined number of cutouts therein, the number of cutouts being defined by indicia selected for which cards are to be displayed.

DESCRIPTION OF THE PREFERRED EMBODIMENTS

Figure 1:
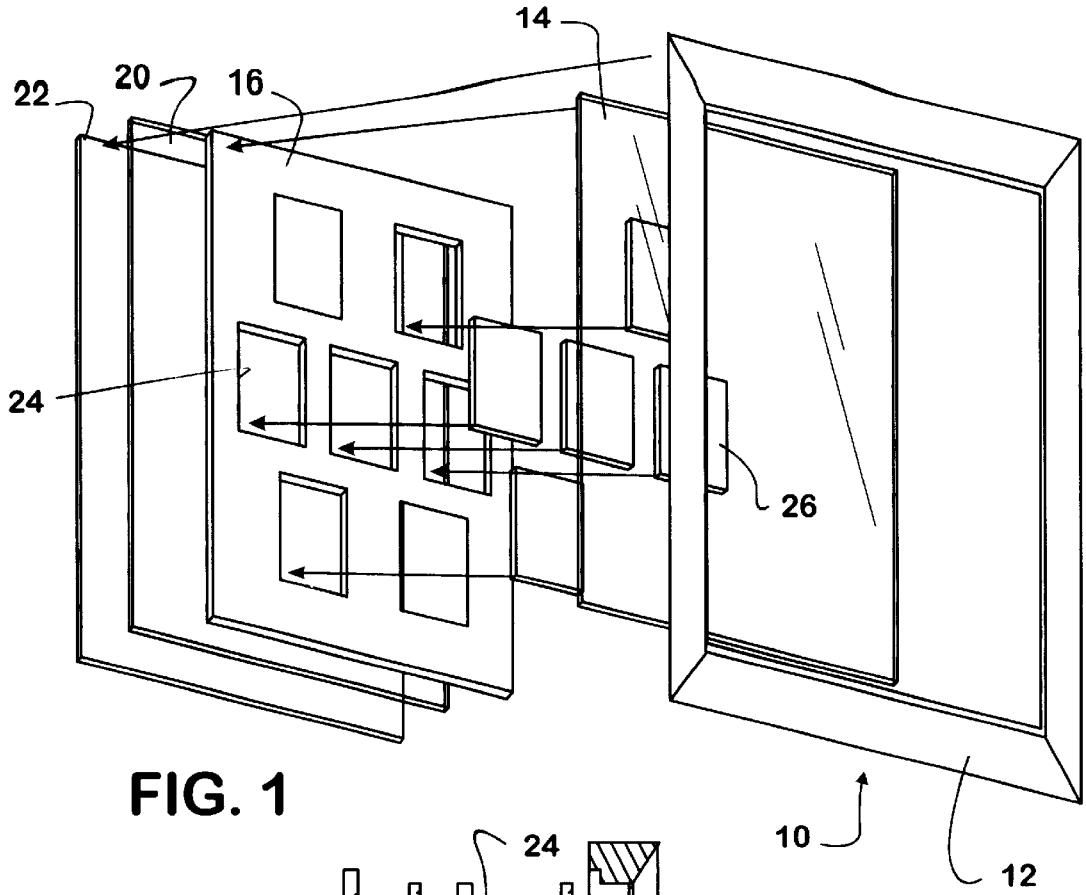
FIG. 1 is a perspective blown apart view of one embodiment a kit made in a accordance with the teachings of the present invention.
Figure 2:
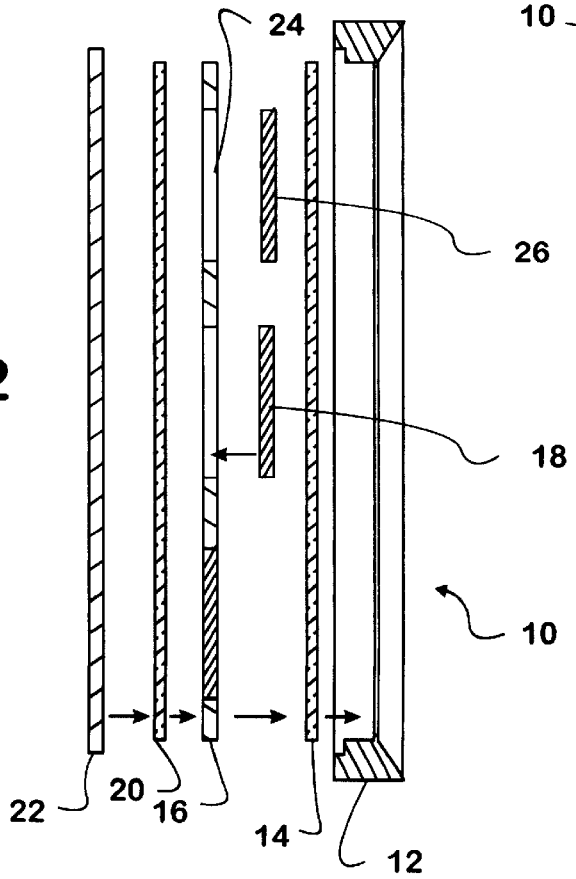
FIG. 2 is a side view through a second embodiment of a kit made in accordance with the teachings of the present invention.

Referring now to the drawings in greater detail, there are illustrated therein various exemplary embodiments of the organizational trading card display kit made in accordance with the teachings of the present invention and generally identified by the reference numeral 10. These exemplary embodiments should not be construed as limiting.

Each kit includes at least a frame 12 within which an inset glass plate 14 is nested. Behind the glass plate 14 is positioned, a mat 16, which is of a thickness at least equal to, if not slightly greater than the thickness of a trading card 18. Pinioning the mat 16 against the framed glass 14 is a second piece of glass 20 followed by a backing 22 which is releasable secured to the frame 12 in a manner compressing the glass 20 against the mat 16 which is, in turn compressed against the glass 14.

The mat 16 includes a plurality of cutouts 24 therein each of which is sized and configured to snugly receive a trading card 18 therein. The number of cutouts 24 in each mat 16 is based on the indicia for the particular display kit 10, as will be defined below.

Also provided are a plurality of blanks 26 created when the cutouts 24 are formed, equal in number to the number of cutouts 24 with the blanks 26 obviously fitting snugly into the cutouts 24.

The above structures define the display kit 10 in its most simplistic form. However, this should not be construed as limiting.

For example, the display kits 10 may be provided for a collector to place his own cards in or, alternatively, if desired, the display kits 10 may also include the trading cards 18 pertaining to the particular kit 10.

Turning now to the indicia for each display kit 10, and using sports trading cards 18 as the example, such indicia may be, for example "1976 OAKLANd RAIDERS"; "JERSEY #31", "BASKETBALL HALL OF FAMERS"; "OLYMPIC GOLD MEDALISTS-SKATING"; "HOME RUN HALL OF FAMERS"; "QUARTERBACK"; "JOE NAMATH"; "BLACK Hawks-1999"; "Babe Ruth-career"; "Soccer Hall of Framers"; "STEEL Curtain"; ad infinitum.

Further, whenever "STAT CARDS" 30, cards bearing statistics, such as for a particular player, or "ROSTER Cards" 30, such as for a team for a particular year, are available, these will also be accommodated for in each display kit 10.

Figure 3:
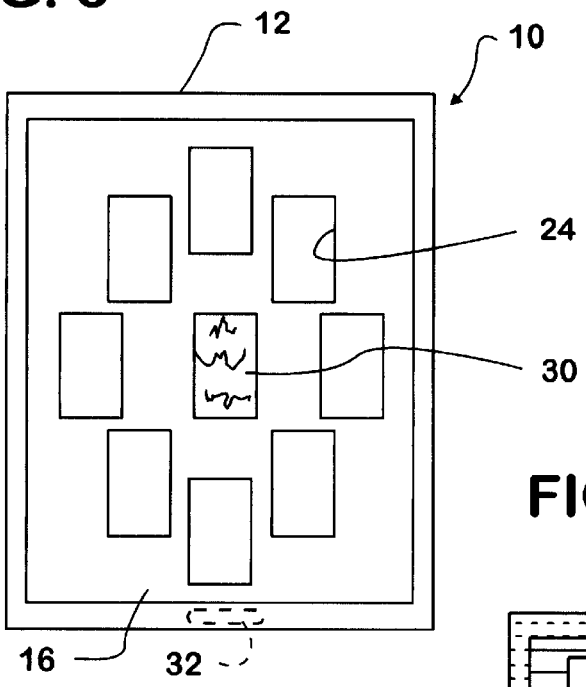
FIG. 3 is a frontal view of a third embodiment of a kit made in accordance with the teachings of the present invention.
Figure 5:
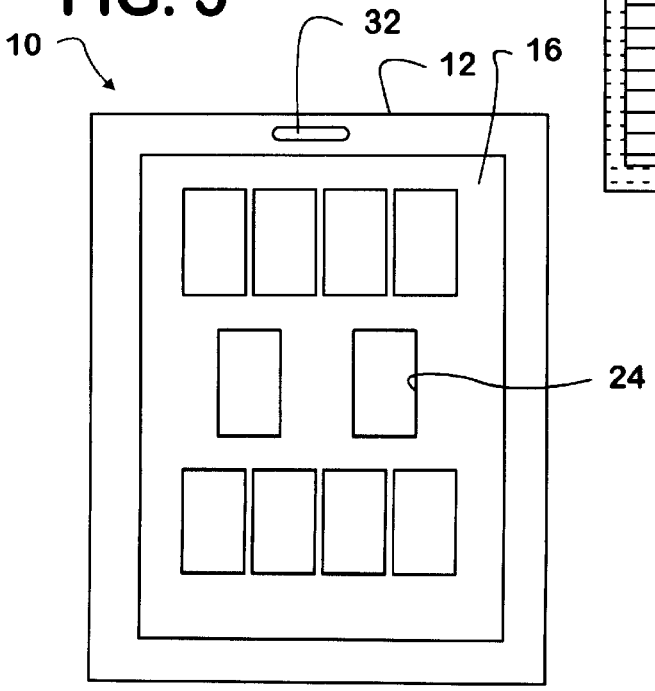
FIG. 5 is a frontal view of a fifth embodiment of a kit made in accord etc.

Still further, where no such cards 30 are available for a particular index, a tag 32 bearing a title for the collection being displayed will be provided as shown in FIG. 5. However, this will not preclude use of a tag 32 even when a card 30 is available, as shown in phantom in FIG. 3.

Figure 4:
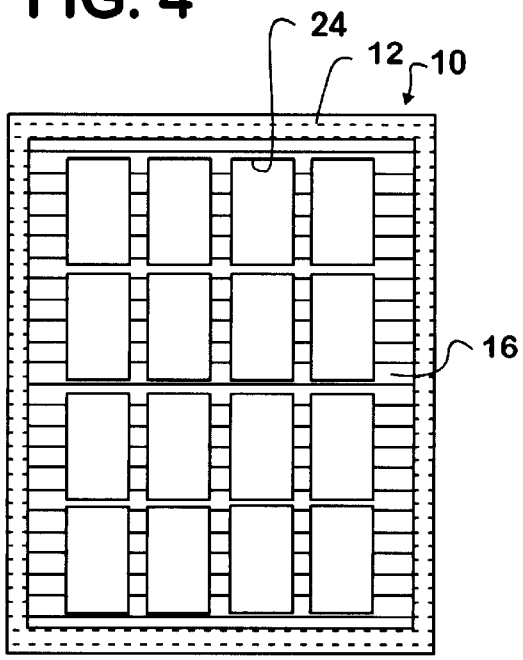
FIG. 4 is a frontal view of a fourth embodiment of a kit.

Still further, it is proposed to provide a mat 16 and frame 12 which may display "team colors" when a particular team is in the index for the collection, as shown in FIG. 4. Here, the frame 12 is shown lined for the color silver and the mat is shown lined for the color blue, to indicate a team with those colors.

It will be understood that in some instances, a card 18, 30 may not be available. For example, the 1976 Raiders team was comprised of 19 players, and thus 19 or 20 cutouts 24 would be provided dependent on the existence of a stat or roster card for the index. A collector may not have all 19 cards. For this reason, the blanks 26 are provided. A blank 26 is inserted into an unused cutout 24, to provide a more aesthetic appearance to the display, hiding the underlying backing 22.

As described above, the display kit 10 of the present invention provides a number of advantages, some of which have been described above and others of which are inherent in the invention. Also modifications may be proposed to the kit 10 with out departing from the teachings herein. For example, the frame 12 may be of any functional shape and may be positioned in any desired orientation, such as horizontally displayed. Accordingly, the scope of the invention is only to be limited as necessitated by the accompanying claims.

I claim:

1. A structured trading card display kit comprising a frame, glass surrounded by and seated within the frame, a mat, a backing, and a second piece of glass, the mat being sandwiched between the pieces of glass, and the mat having a predefined number of cutouts therein, the number of cutouts being defined by indicia selected for which cards are to be displayed.

2. The kit of claim 1 wherein blanks created by creation of said cutouts are included for placement back into cutouts which contain no cards.

3. The kit of claim 1 wherein the frame is of a color indicative of one team color of a particular team when the indicia is a team.

4. The kit of claim 3 wherein the mat is of a color indicative of a second team color of the particular team.

5. The kit of claim 1 including trading cards corresponding to the indicia for the kit.

6. The kit of claim 1 not including any trading cards.

7. The kit of claim 1 wherein the mat is of a thickness substantially similar to a thickness of a trading card.

8. The kit of claim 1 wherein any suitable plurality of cutouts can be provided in the mat.

9. The kit of claim 1 wherein the frame is vertically oriented.

10. The kit of claim 1 wherein the frame is horizontally oriented.

11. The kit of claim 1 wherein a tag identifying the indicia is provided for attachment to the frame.

12. The kit of claim 1 wherein a tag identifying the indicia is provided on the frame.

13. The kit of claim 1 wherein a tag identifying the indicia is provided for attachment to the mat.

14. The kit of claim 1 wherein a tag identifying the indicia is provided for attachment to the glass surrounded by and seated within the frame.

15. The kit of claim 1 wherein the frame and mat do not display team colors when the indicia is a particular team.

* * * * *